US008606160B2

(12) United States Patent
Nakase et al.

(10) Patent No.: US 8,606,160 B2
(45) Date of Patent: Dec. 10, 2013

(54) IMAGE HEATING APPARATUS HEATING A TONER IMAGE ON A SHEET BY THE MAGNETIC FLUX FROM AN EXCITATION COIL AND CONTROLLING THE ELECTRIC POWER SUPPLY TO THE COIL

(71) Applicant: Canon Kabushiki Kaisha, Tokyo (JP)

(72) Inventors: Takahiro Nakase, Toride (JP); Yasuo Nami, Toride (JP); Naoyuki Yamamoto, Toride (JP); Hitoshi Suzuki, Matsudo (JP); Toshiharu Kondo, Moriya (JP); Yasuhiro Yoshimura, Ryugasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/712,150

(22) Filed: Dec. 12, 2012

(65) Prior Publication Data

US 2013/0098900 A1 Apr. 25, 2013

Related U.S. Application Data

(62) Division of application No. 13/323,175, filed on Dec. 12, 2011, now Pat. No. 8,358,949, which is a division of application No. 11/254,706, filed on Oct. 21, 2005, now Pat. No. 8,099,008.

(30) Foreign Application Priority Data

Oct. 22, 2004 (JP) ..... 2004-308337

(51) Int. Cl.
*G03G 15/20* (2006.01)

(52) U.S. Cl.
USPC ..... 399/328

(58) Field of Classification Search
USPC ..... 399/328
See application file for complete search history.

(56) References Cited

U.S. PATENT DOCUMENTS 5,464,964 A 11/1995 Okuda et al.
5,994,671 A 11/1999 Suzuki et al.

(Continued)

FOREIGN PATENT DOCUMENTS

EP 1 193 573 4/2002
JP 56-072470 A 6/1981

(Continued)

OTHER PUBLICATIONS

Translation of Apr. 18, 2008 Notification of the First Office Action in Chinese Patent Application No. 2005-10116389.7.

(Continued)

*Primary Examiner* — Quana M Grainger
(74) *Attorney, Agent, or Firm* — Fitzpatrick, Cella, Harper & Scinto

(57) ABSTRACT

An image heating apparatus includes a coil for generating a magnetic flux by a current flowing therethrough; an image heating member having an electroconductive layer in which an eddy current is produced by the magnetic flux by which heat is generated, the image heating member being effective to heat an image on a recording material; an electroconductive magnetic flux adjusting member movable from a first position and a second position to decrease the eddy current produced in the image heating member by the magnetic flux; a temperature sensor for sensing a temperature of image heating member; electric power control means for control electric power supplied to the coil on the basis of an output of the temperature sensor, wherein the electric power control means changes an electric power condition to be supplied to the coil before start of the movement from the first position to the second position of magnetic flux adjusting member.

9 Claims, 13 Drawing Sheets

(56) References Cited

U.S. PATENT DOCUMENTS

| | | | |
|---|---|---|---|
| 6,373,036 | B2 | 4/2002 | Suzuki |
| 6,643,476 | B1 | 11/2003 | Kinouchi et al. |
| 6,782,216 | B2 | 8/2004 | Suzuki |
| 6,969,833 | B2 | 11/2005 | Suzuki |
| 6,970,664 | B2 | 11/2005 | Yamamoto |
| 7,034,261 | B2 | 4/2006 | Suzuki |
| 7,038,178 | B2 | 5/2006 | Suzuki |
| 7,098,430 | B2 | 8/2006 | Kondo et al. |
| 7,122,769 | B2 | 10/2006 | Nami et al. |
| 7,132,631 | B2 | 11/2006 | Nami et al. |
| 2002/0148828 | A1 | 10/2002 | Nagahira |
| 2002/0158063 | A1 | 10/2002 | Kawase |
| 2003/0091359 | A1 | 5/2003 | Cho et al. |
| 2005/0173415 | A1 | 8/2005 | Yamamoto et al. |
| 2005/0252912 | A1 | 11/2005 | Yamamoto |
| 2006/0086719 | A1 | 4/2006 | Suzuki et al. |
| 2006/0086720 | A1 | 4/2006 | Nakase et al. |
| 2006/0086724 | A1 | 4/2006 | Yamamoto et al. |
| 2006/0086726 | A1 | 4/2006 | Yamamoto et al. |
| 2006/0086730 | A1 | 4/2006 | Kondo et al. |
| 2006/0088327 | A1* | 4/2006 | Nakase et al. ..... 399/69 |
| 2006/0088328 | A1 | 4/2006 | Yoshimura et al. |
| 2006/0088329 | A1 | 4/2006 | Suzuki et al. |

FOREIGN PATENT DOCUMENTS

| | | | |
|---|---|---|---|
| JP | 58-200262 | A | 11/1983 |
| JP | 59-33787 | A | 2/1984 |
| JP | 59-045475 | A | 3/1984 |
| JP | 9-171889 | A | 6/1997 |
| JP | 2000-122466 | A | 4/2000 |
| JP | 2002-189380 | A | 7/2002 |
| JP | 2002-287563 | A | 10/2002 |

OTHER PUBLICATIONS

Chinese Office Action dated Jun. 9, 2011, in counterpart Chinese Application No. 200810170426.6, and English-language translation thereof.

* cited by examiner

| | NON-SHIELD | SHIELD |
|---|---|---|
| REF. PWR | 700W | 500W |
| COR. COEFFICIENT | 4W/℃ | 2W/℃ |

IMAGE HEATING APPARATUS HEATING A TONER IMAGE ON A SHEET BY THE MAGNETIC FLUX FROM AN EXCITATION COIL AND CONTROLLING THE ELECTRIC POWER SUPPLY TO THE COIL

This is a divisional of application Ser. No. 13/323,175, filed on Dec. 12, 2011, now allowed, which is a divisional of application Ser. No. 11/254,706, filed on Oct. 21, 2005, and issued as U.S. Pat. No. 8,099,008 on Jan. 17, 2012.

BACKGROUND OF THE INVENTION

Field of the Invention

The present invention relates to an image forming apparatus such full-color printer which employs one of the electrophotographic image forming methods. In particular, it relates to an image heating apparatus which uses one of the heating methods based on electromagnetic induction, in order to heat an image on recording medium.

In recent years, attention has come to be paid to the reduction of a heating apparatus in energy consumption (electric power consumption) while improving it in usability (in terms of faster printing speed), and the amount of the attention has been rapidly increasing; such an attempt at energy consumption reduction has come to be taken very seriously.

As an apparatus capable of satisfying the above described demand, there is the heating apparatus proposed in Japanese Laid-open Patent Application 59-33787, which employs one of the heating methods based on electromagnetic induction, that is, a heating apparatus employing high frequency electric current as a heat source. This heating apparatus based on electromagnetic induction is made up of a hollow fixation roller formed of an electrically conductive metallic substance, and a coil disposed in the hollow of the fixation roller so that its axial line coincides with that of the fixation roller. In operation, eddy current is induced in the wall of the fixation roller by the high frequency magnetic field generated by flowing high frequency electric current through the coil, and the fixation roller is directly heated by the heat (Joule heat) generated in the wall of the fixation roller by the interaction between the thus generated eddy current and the surface resistance of the fixation roller itself. An electromagnetic induction-based heating method such as the one employed by this heating apparatus is very high in electrothermal transduction efficiency, making it possible to substantially reduce a heating apparatus in warm-up time.

However, an image heating apparatus employing an electromagnetic induction-based heating method suffers from the following problem. That is, when fixing an image to a recording medium, which is smaller in dimension, in terms of the lengthwise direction of the fixation roller, than the fixation roller, the portion of the fixation roller within the path of the recording medium is robbed of heat by the recording medium, whereas the portions of the fixation roller outside the path of the recording medium are not robbed of heat. Therefore, the portions of the fixation roller outside the path of the recording medium continue to increase in temperature. This increase in temperature across the portions of the fixation roller outside the recording medium path is more conspicuous in the case of an image heating apparatus employing an induction-based heating method, because a heating method based on electromagnetic induction is higher in electrothermal transduction efficiency as described above.

As one of the means for dealing with this problem, a method for controlling temperature in the portions of the fixation roller outside the recording medium path by blowing air against the out-of-path portions of the fixation roller has been proposed, for example, the one disclosed in Japanese Laid-open Patent Application 2002-189380. This method, however, cools the portions of the fixation roller outside the recording medium path by driving an air blowing means such as a fan, after they are heated. Therefore, a certain portion of the cooling air sometimes infringes upon the out-of-path portions of the fixation roller, reducing substantially the heating apparatus in efficiency.

Japanese Laid-open Patent Application 9-171889 discloses another means, as a replacement for the above described one, for dealing with the above described problem. This method employs a magnetic flux blocking plate to prevent heat from being generated in the out-of-path portions of a fixation roller. More specifically, the magnetic flux blocking member is formed of one of the nonmagnetic substances which are electrically conductive (allowing therefore electric current induced therein to flow through it) and low in specific resistance. This magnetic flux blocking member is positioned so that its magnetic flux blocking portions oppose the portions of the coil, which correspond in position to the out-of-path portions of the fixation roller. In other words, the portions of the magnetic flux, which are directed toward the out-of-path portions of the fixation roller, are blocked by the magnetic flux blocking member to prevent heat from being generated in the out-of-path portions of the fixation roller.

In order to minimize the amount by which heat is generated in the magnetism blocking plate by the eddy current induced therein by the magnetic flux from the coil, the magnetism blocking plate is designed to be small in electrical resistance.

Japanese Laid-open Patent Application 2002-287563 discloses a fixing apparatus design which addressed the concerns regarding the above described design. According to this patent application, when the magnetic field blocking member is partially blocking the magnetic field, an electric current control sequence different from that used when the magnetic field blocking member is not blocking the magnetic field, is used in order to reduce the fixation roller in the temperature ripple in terms of the circumferential direction of the fixation roller.

However, if the magnetism blocking plate is inserted while the amount by which electric power is supplied to the coil is controlled in order to keep the surface temperature of the fixation roller at a predetermined level, the following problem occurs.

If the coil is supplied with the same amount of electric power as that supplied before the magnetism blocking plate is inserted, while the magnetism blocking plate, which is lower in electrical resistance than the fixation roller, is inserted, the electric current value suddenly increases due to the decrease in the electrical resistance value. As a result, the temperature of the fixation roller excessively increases across the portion within the path of a recording medium.

SUMMARY OF THE INVENTION

Thus, the primary object of the present invention is to prevent an eddy current from flowing through the coil of an induction-based image heating apparatus while the magnetic blocking member of the image heating apparatus is moved in order to reduce the amount of magnetism that reaches the image heating member of the image heating apparatus.

According to an aspect of the present invention, there is provided an image heating apparatus comprising a coil for generating a magnetic flux by a current flowing therethrough; an image heating member having an electroconductive layer in which an eddy current is produced by the magnetic flux by which heat is generated, said image heating member being effective to heat an image on a recording material; an electroconductive magnetic flux adjusting member movable from a first position and a second position to decrease the eddy current produced in said image heating member by the magnetic flux; a temperature sensor for sensing a temperature of image heating member; electric power control means for control electric power supplied to said coil on the basis of an output of said temperature sensor, wherein said electric power control means changes an electric power condition to be supplied to said coil before start of the movement from the first position to the second position of magnetic flux adjusting member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(Image Forming Apparatus)

Figure 2:
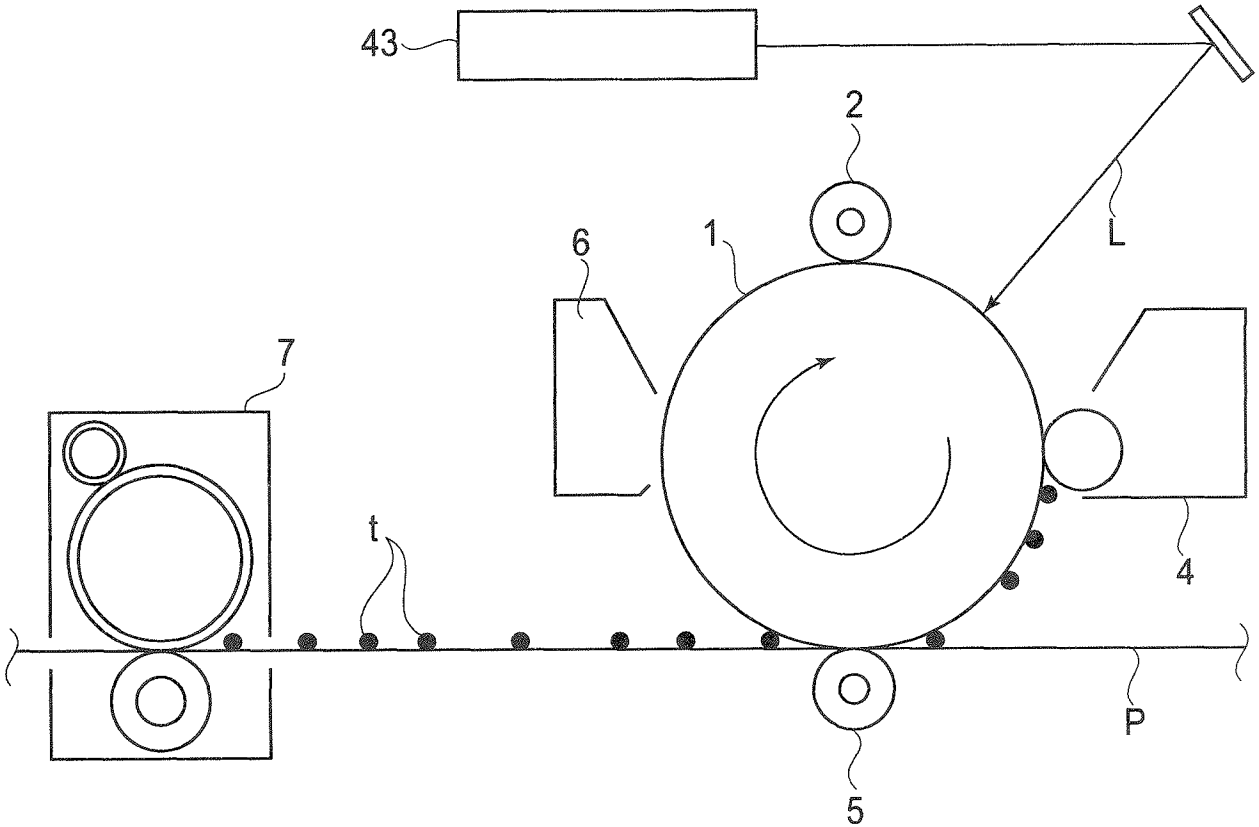
FIG. 2 is a schematic sectional view of a typical electrophotographic image forming apparatus, showing the general structure thereof.
Figure 3:
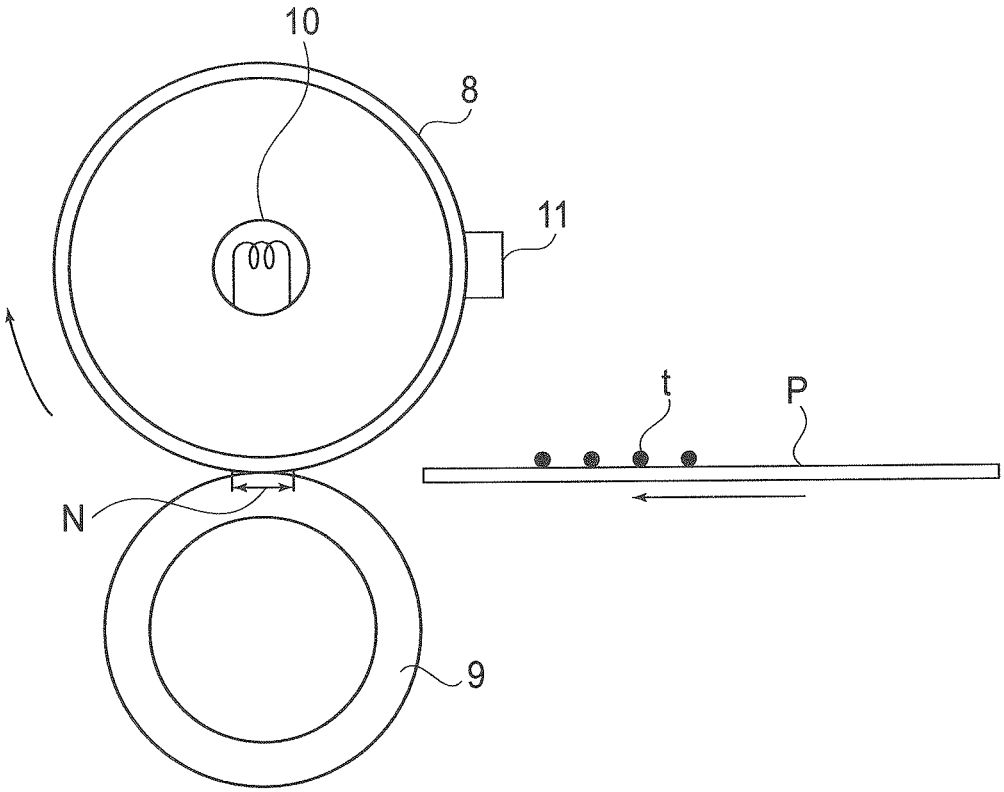
FIG. 3 is a schematic sectional view of a typical fixing apparatus, showing the general structure thereof.

First, referring to FIG. 2, the image forming apparatus in this embodiment will be described. The photosensitive drum 1 as an image bearing member is charged by a charge roller 2 as a charging means. The charged peripheral surface of the photosensitive drum 1 is exposed to a beam of laser light projected, while being modulated with video signals, from a laser-based exposing apparatus as an exposing means. As a result, an electrostatic latent image is formed on the peripheral surface of the photosensitive drum 1. Then, a visible image is formed of toner by a developing means 4, on the peripheral surface of the photosensitive drum 1, based on the electrostatic latent image on the peripheral surface of the photosensitive drum 1. The image formed of toner (which hereinafter will be referred to as toner image) on the photosensitive drum 1 is transferred onto transfer medium, which in this embodiment is a sheet of recording paper. Incidentally, the transfer medium may be different from the transfer medium in this embodiment; for example, it may be an intermediary transfer medium or the like. After being transferred onto the recording paper, the toner image, which is an unfixed image at this point, is thermally fixed to the surface of the recording paper by a fixing means 7, which will be described later. After the transfer of the toner image, the toner remaining on the peripheral surface of the photosensitive drum 1 is removed by a cleaning means 6 such as a cleaning blade or the like. When forming another image, the same steps as the above-described ones are repeated.

(Heating Apparatus Based on Electromagnetic Induction)

Figure 4:
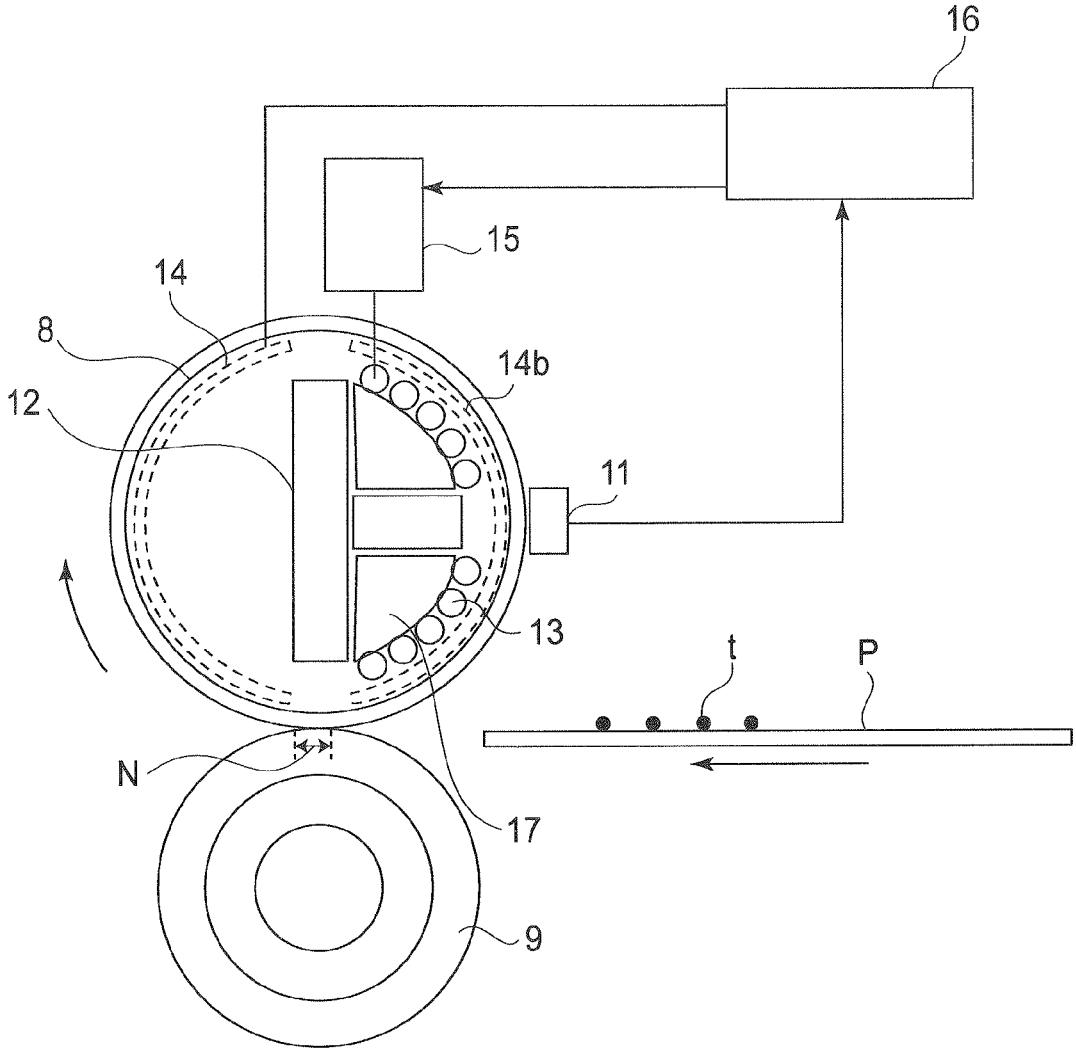
FIG. 4 is a schematic cross-sectional view of an induction-based heating apparatus, in accordance with the present invention, having a magnetism blocking means, showing the general structure thereof.

FIG. 4 is a sectional view of the induction-based heating apparatus, as an image heating apparatus, in the first embodiment of the present invention.

The fixation roller 8 as an image heating member is 40 mm in external diameter, 0.7 mm in wall thickness, and 340 mm in length. It is made up of a metallic core formed of iron, and a layer of fluorinated resin, such as PFA or PTFE, coated on the peripheral surface of the metallic core to improve the fixation roller 8 in toner releasing property. It may be provided with a heat resistant elastic layer, for example, a layer of silicon rubber, which is placed between the peripheral surface of the metallic core and the surface layer.

The pressure roller 9 as a pressure applying member is 38 mm in external diameter, 3 mm in wall thickness, and 330 mm in length. It is made up of a hollow metallic core, and a thermally insulating layer formed on the peripheral surface of the metallic core, of heat resistant rubber with the toner releasing property. It may be provided with a layer of fluorinated resin, such as PFA or PTFE, as a surface layer for improving the pressure roller 9 in the toner releasing property.

The heat roller 8 and pressure roller 9 are rotatably supported, and are kept pressed against each other by an unshown pressure application mechanism, forming a fixation nip N with a width of roughly 5 mm, through which recording medium is conveyed while remaining pinched by the heat roller 8 and pressure roller 9. The heat roller 8 is driven by an unshown motor at a peripheral velocity of 300 min/sec, whereas the pressure roller 9 is rotated by the rotation of the heat roller 9 using the friction in the fixation nip N between the heat roller 8 and pressure roller 9. A recording sheet P as the recording medium in this embodiment is introduced into the fixation nip N while bearing an unfixed toner image t, and while the recording sheet P is conveyed through the fixation nip N, the unfixed toner image on the recording sheet P is fixed by the heat and pressure in the fixation nip N.

The induction coil 13 is held to the core 12 and stay 17 by the holder formed of one of the heat resistant magnetic resins such as PPS, PEEK, phenol resin, etc. Through this induction coil 13, AC current, the frequency of which is in a range of 10-100 kHz, is flowed, inducing thereby a magnetic field, which in turn induces eddy current in the electrically conductive layer of the heat roller 8. As a result, heat (Joule heat) is generated in the wall of the heat roller 8. As for the means to increase the amount by which heat is generated in the wall of the heat roller 8, it is possible to increase the number of times the coil is wound around the core 12, to use a substance such as ferrites, Permalloy, or the like, which is high in magnetic permeability and low in residual magnetic flux density, as the material for the core 12, to increase the AC current in frequency, or to employ like means.

Figure 14:
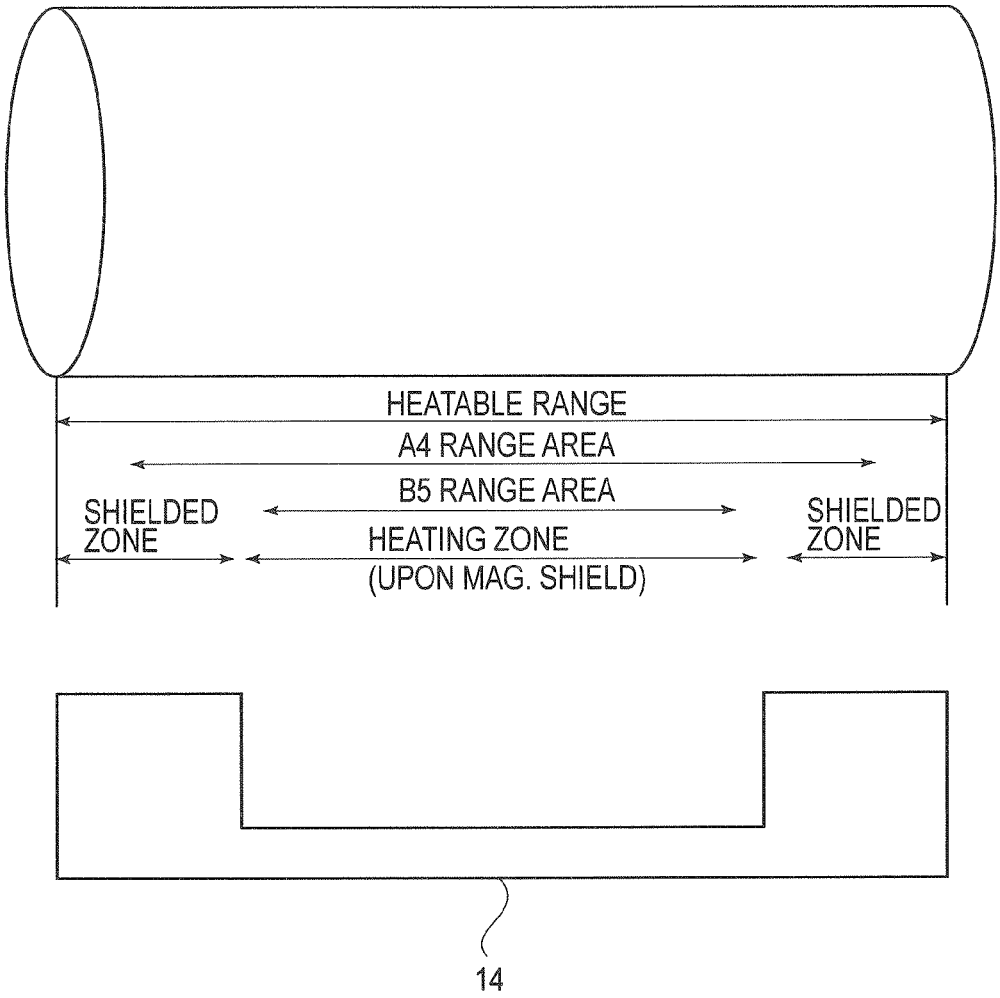
FIG. 14 is a diagrammatic drawing showing the approximate relationship between the entirety of the lengthwise heatable range of the fixation roller, and the portions of the lengthwise heatable range of the fixation roller shielded from the magnetism, in the following embodiments of the present invention.

The shutter as a magnetism adjusting member is disposed so that it can be moved through the gap between the coil 12 and fixation roller 8. Referring to FIG. 14, when the fixation roller 8 needs to be heated across the entirety of its functional range in terms of its lengthwise direction, the shutter is kept in a first position, that is, the retreat position 14, whereas when it needs to be heated across only the center portion thereof, that is, when the recording medium to be conveyed through the fixing apparatus is of the size smaller than the size of the largest (widest) recording medium usable with the fixing apparatus is conveyed, the shutter is moved into a second position 15, in which the shutter is placed directly between the coil 12 and fixation roller 8 to shield the portions of the fixation roller 8, which do not need to be heated, from the magnetism. The magnetism adjusting member is desired to be formed of a substance which is electrically conductive, non-magnetic, and small in specific resistance. For example, it is desired to be formed of copper, aluminum, silver, alloys thereof, or the like. The magnetism adjusting member in this embodiment is formed of copper. For the purpose of preventing the coil 12 from increasing in temperature, and also, minimizing the amount by which heat is generated in the magnetism adjusting member itself, the specific resistance of the magnetism adjusting member is desired to be smaller than that of the material for the image heating member.

For the purposes of the following description, one can consider the heat generating means inclusive of the fixation roller as a simple electrical circuit.

The amount of heat W generated in the wall of the fixation roller can be roughly calculated with the use of the following equation (1), in which the letters I and R stand for the current and resistance, respectively:

$$W \propto I^2 R \tag{1}$$

Here, the difference, in the amount by which heat is generated, between when the magnetism is not adjusted and when it is adjusted, will be discussed.

Figure 5:
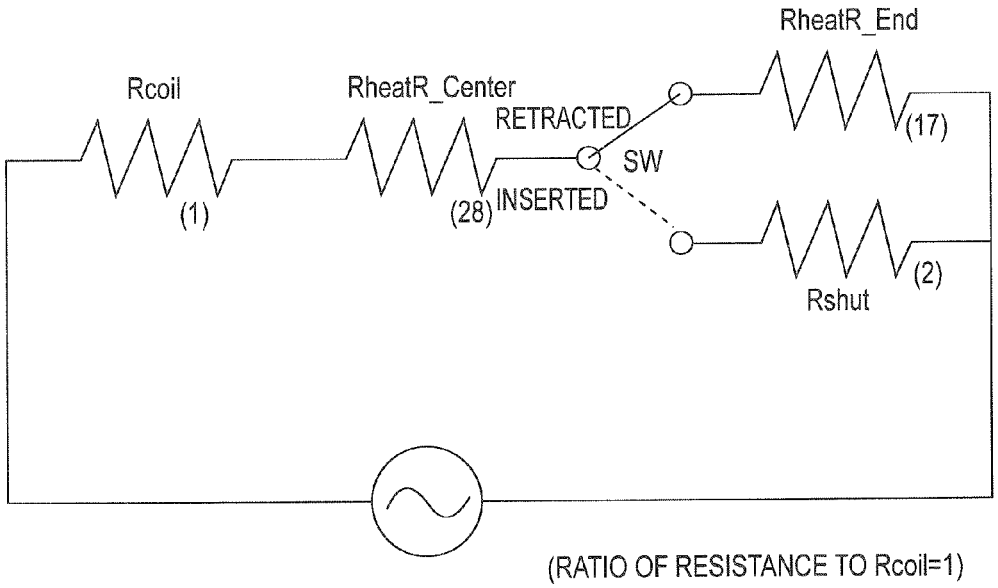
FIG. 5 is an equivalent circuit of the induction-based heating apparatus in the first embodiment of the present invention.

First, the changes in the resistance R in Equation (1) will be discussed. FIG. 5 is a simplified version of an equivalent circuit of the heating means, and the insertion or retraction of the shutter is designated by a referential symbol SW in FIG. 5. Induction heating also involves the coil L. However, for simplification, the coil L is not shown, and only the resistance R involved in the heating is shown. A symbol $R_{coil}$ a stands for the internal resistance of the coil. The resistance of the fixation roller is divided into two portions: $R_{heatR\text{-}Center}$ which is the resistance of the lengthwise center portion of the fixation roller, and $R_{heatR\text{-}End}$ which is the resistance of the lengthwise end portions of the fixation roller shielded from the magnetism by the magnetism blocking member. A referential symbol $R_{shut}$ stands for the resistance of the lengthwise end portions of the fixation roller after the insertion of the magnetism blocking member. The value of the resistance $R_{coil}$ can be obtained by measuring the voltage applied to the coil and the amount of the current which flows through the coil. The value of ($R_{coil}$+$R_{heatR\text{-}Center}$+$R_{heatR\text{-}End}$) can be obtained from the amount of the electric current flowed, and the amplitude of the voltage applied, while the fixation roller is heated by electromagnetic induction. The ratio between $R_{heatR\text{-}Center}$ and $R_{heatR\text{-}End}$ roughly equals the ratio between the length of the lengthwise portion of the fixation roller which is not shielded from the magnetism, and the total length of the lengthwise portions of the fixation roller which are shielded from the magnetism. Thus, the values of the $R_{heatR\text{-}Center}$ and $R_{heatR\text{-}End}$ can be easily obtained, because the value of $R_{shut}$ can be obtained from the value of ($R_{coil}$+$R_{heatR\text{-}Center}$+$R_{shut1}$) obtained by moving the magnetism adjusting member into the magnetism blocking position, and the value of ($R_{coil}$+$R_{heatR\text{-}Center}$) obtained as described above. In this embodiment, the ratio of the these electrical resistance values obtained when the ambient temperature was normal and the applied AC voltage was 30 kHz was:

$$R_{coil}:R_{heatR\text{-}Center}:R_{heatR\text{-}End}:R_{shut}=1:28:17:2.$$

The reason why $R_{shut}$ is small is that the shutter is formed of copper, being therefore small in the resistance value per unit area.

The total resistance of the heating means when the magnetism is not blocked is:

$$R_{coil}+R_{heatR\text{-}Center}+R_{heatR\text{-}End} \tag{2},$$

and the total resistance of the heating means when the magnetism is partially blocked is:

$$R_{coil}+R_{heatR\text{-}Center}+R_{shut} \tag{3}$$

The induction-based heating apparatus in this embodiment is controlled with the use of one of the ordinary power controlling methods so that the amount of the electric power supplied thereto remains constant. More specifically, the amount of electric power supplied to the heating apparatus is kept constant by controlling the current pulse while monitoring the voltage between the two terminals of the coil with the use of a high frequency invertor. As for the power supply to the high frequency invertor, it is kept constant by controlling the current while monitoring the voltage. The reason for using the above described control is that the amount by which heat is generated is essential to a fixing apparatus, and a method for controlling a heating apparatus by controlling the amount of the coil current allows the amount of the electric power supplied to the heating apparatus to fluctuate as the voltage fluctuates. Thus, employment of this method for ordinary appliances which is unrealistic, because ordinary appliances are limited in the available amount of electric power.

When the amount of power P inputted to the magnetic flux generating means is $P_{in}$; the total amount of electrical resistance is R; and the current which flows through the coil is I, the amount of the current which flows through the circuit can be expressed by the following equation (4):

$$I=(P_{in}/R)^{1/2} \tag{4}.$$

Here, the ratio between the resistance $R_{NB}$ of the circuit when the magnetism is not blocked and the resistance $R_B$ of the circuit when the magnetism is partially blocked can be obtained from the following equation (5):

$$R_{NB}/R_B=+R_{heatR_Center}+R_{heatR_End})/(R_{coil}+R_{heatR_Center}+R_{shut})=1.56$$

According to Equation (4), if the amount of electric power input $P_{in}$ is controlled so that it remains constant, the amount of the current I changes in response to the changes in the value of the resistance R. From Equation (5), the amount of the current I which flows while the magnetism is not blocked is 1.25 times ($=1.56^{1/2}$) that which flows while the magnetism is partially blocked.

In other words, the amount of the current I in Equation (1) increases. Therefore, if the fixation roller is heated by generating heat therein by supplying the magnetic flux generating means with the same amount of electric power as that which is to be supplied while the magnetism is not blocked, while the magnetism is blocked, the amount of the heat generated in the coil, and the amount of the heat generated in the center portion of the fixation roller, increase to 1.56 times that which is generated while the magnetism is partially blocked.

The following is the actual control method with which the inventors of the present invention came up in consideration of the above described concerns.

In this embodiment, when the magnetism needs to be blocked, the fixation roller is heated by electromagnetic induction, based on a magnetic field generating means control table different from the one used when the magnetism does not need to be blocked. The magnetic field generating means control table in this embodiment is related to the amount of electric power supplied to drive the magnetic field generating means. It shows the base amount of electric power and the adjustment ratio. A magnetic field generating means control table may show the amount of the current to be flowed through the coil of the magnetic flux generating means, and the parameters may be the recording medium type, ambience, or the like.

Figure 9:
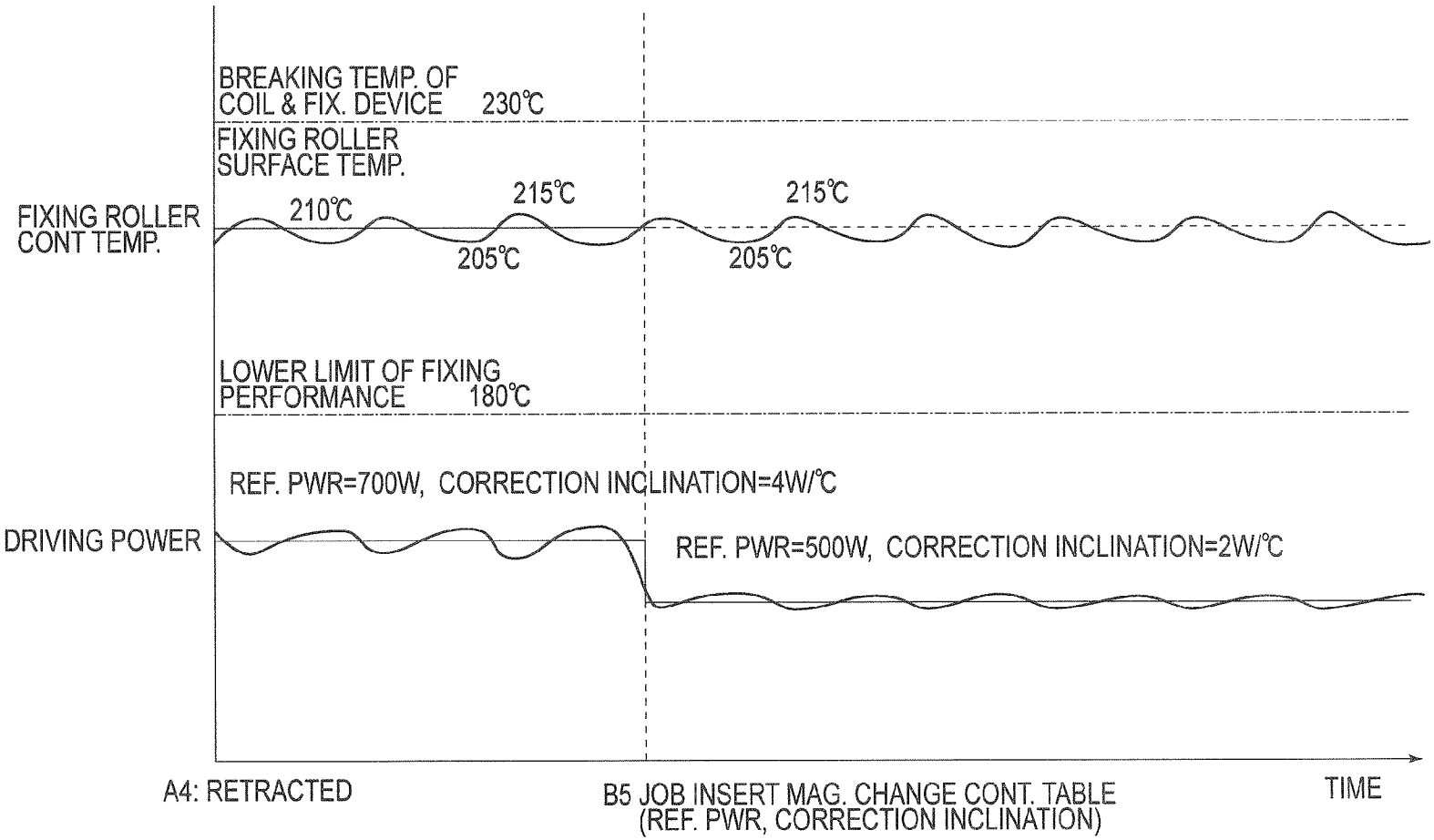
FIG. 9 is also a diagrammatic drawing showing the relationship between the changes in the temperature of the fixation roller and the amount of the electric power input, in the first embodiment of the present invention.

Here, it is assumed that a user selected a job in which multiple copies are continuously made using recording sheets of size A4. FIG. 9 shows the temperature distribution of the fixation roller, and the changes in the amount of the electric power input, which occurred during the job. When a recording sheet of size A4 is used as the recording medium, the fixation roller needs to be heated in its entirety in terms of its lengthwise direction, and therefore, the magnetism blocking member was kept in the retreat, position. For this job, the fixation temperature was kept at 210° C. The temperature level above which the fixing apparatus, in particular, the coil thereof, would have been damaged was 230° C., and the temperature level below which image fixation would not be satisfactory was 180° C. From the table in FIG. 10, the base amount of electric power to be supplied to drive the magnetic flux generating means was 700 W, and the adjustment ratio was 4 W/° C. The control apparatus 16 controlled the amount of electric power 15 for driving the magnetic flux generating means, in response to the temperature level detected by the thermistor 11 disposed in the adjacencies of the heat roller of the fixing apparatus as shown in FIG. 4. More specifically, the amount of the electric power input was continually changed in response to the values obtained using the following equation:

$$\text{Amount of electric power input}=\text{amount of base electric power input}+\text{adjustment ratio}\times(\text{fixation temperature level}-\text{detected temperature level}) \quad (8)$$

When the temperature level detected at a given moment was 203° C., the amount of electric power input was set to 740 W (=700+4×(210−203)), that is, the value calculated using Equation (8). The temperature level detected at the next moment was 213° C., and, therefore, the amount of the electric power input was set to 708 W, which was obtained through the same calculation. The temperature level detected at the next moment was 213° C., and, therefore, the amount of the electric power input was set to 688 W. With the repetition of these steps, the temperature of the heat roller remained in the adjacencies of 210° C., which was the predetermined target temperature level for temperature control, although the temperature of the heat roller fluctuated upward or downward. The magnitude of the temperature ripple under this control was 115° C. In other words, the temperature of the heat roller rose to as high as 215° C.

Next, it is assumed that a user selected a job in which multiple copies are continuously made using recording sheets of size B5. When a recording sheet of size B5 is used for image formation, the heat roller has to be heated across only a part thereof, in terms of its lengthwise direction. Therefore, as soon as the job was started, the magnetism blocking member was inserted in response to the signal from the control apparatus 16. Referring to FIG. 14, the portion of the heat roller, which was to be heated for this job, was roughly the same in dimension, in terms of the lengthwise direction of the heat roller, as the width of the recording medium of size B5. Thus, if the same amount of electric power as was inputted for the preceding job, had been inputted for the reason such as the one described above, the temperature increase across the center portion of the heat roller would have become greater; the detected magnitude of the upward temperature ripple was upward of +30° C. and downward of −10° C. Thus, if the temperature level for image fixation was left at 210° C., the temperature level of the center portion of the heat roller might have risen to as high as 240° C., at or above which the coil will be damaged. The magnitude of the temperature ripple was as high as 40° C. Therefore, the portions of the unfixed image, which would have been fixed at the top end of the temperature ripple, would have become different in the level of glossiness from the portions of the unfixed image, which would have been fixed at the bottom end of the temperature ripple. In other words, the recording medium and the image thereon would have become nonuniform in glossiness. In this embodiment, therefore, as soon as the blocking of the magnetism began, the control table was switched to the one shown in FIG. 10. That is, the base amount of electric power supplied to the magnetic flux generating means, and the adjustment ratio, were switched to 500 W and 2 W/° C., while the temperature level for image fixation was kept at 210° C. With these changes, the magnitude of the temperature ripple reduced to ñ5° C., which was the same as that during the period in which magnetism was not blocked. Therefore, the temperature of the center portion of the heat roller reached no higher than 215° C., and fell no lower than 205° C. In other words, not only did the excessive temperature rise not occur, but also, the fixation occurred without the occurrence of the problem of nonuniformity in glossiness.

Figure 7:
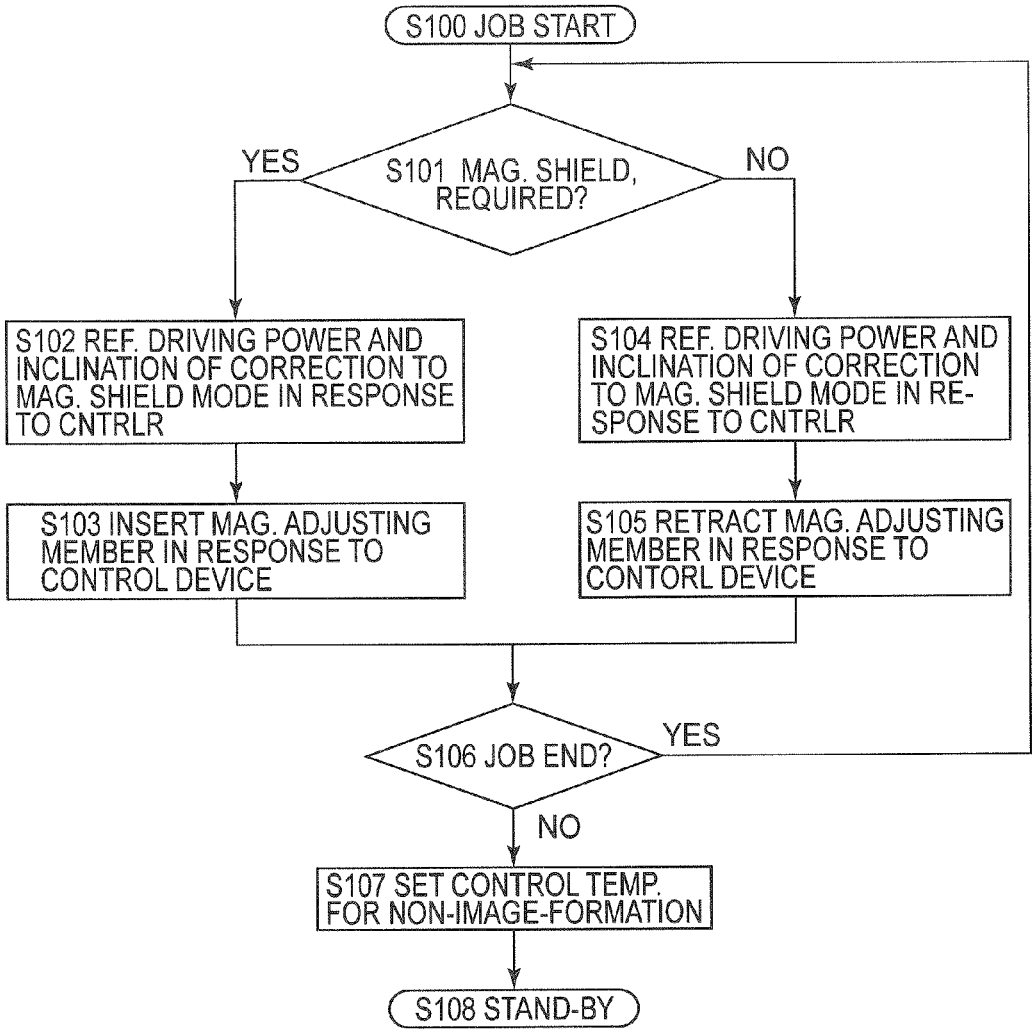
FIG. 7 is a flowchart of the control sequence in the first embodiment of the present invention.

Next, this process will be described in more detail with reference to the flowchart in FIG. 7.

First, the type of job to be carried out is inputted in Step S100. In Step S101, it is determined whether or not the magnetism needs to be blocked by the magnetism adjusting member. For example, when the width of the recording sheet is equal to that of a recording sheet of size A4, in terms of the direction perpendicular to the recording medium conveyance direction, it is determined that the magnetism does not need to be blocked, whereas if it is no more than that of a recording sheet of size B5, it is determined that the magnetism needs to be partially blocked. Further, if the temperature of the portions of the heat roller outside the recording medium path rises above the predetermined level for image fixation while recording sheets, the width of which is no more than size B5, are conveyed, it is determined that the magnetism needs to be partially blocked. When the magnetism needs to be partially blocked, Step S102 is taken, in which as a magnetic blocking signal is input, the base amount of electric power and corresponding adjustment ratio, which have been used, are switched to those for when the magnetism needs to be partially blocked. Then, the movement of the magnetism adjusting member is started (S103).

It is necessary that before, or at the same time as, moving the magnetism blocking member, the amount by which electric power is to be supplied while the magnetism blocking member is moved (second power control) must be switched to the amount by which electric power is to be supplied during the normal operation (when magnetism does not need to be partially blocked)(first power control). In this embodiment, the same power control is used while the magnetism adjusting member is moved, and after the magnetism adjusting member is moved into the second position. However, the power control used while the magnetism adjusting member is moved may be rendered different from that used after the magnetism adjusting member is moved into the second position, and this will not cause any problem. If it is determined that the magnetism does not need to be partially blocked in Step S101, the normal power control is carried out (S104), and it is confirmed that the magnetism adjusting member is in the first position (S105). Then, it is determined whether or not the job has been completed (S106). If it is confirmed that the job has been completed, the fixing apparatus is put on standby (S107), and the operation is ended (S108).

Figure 1:
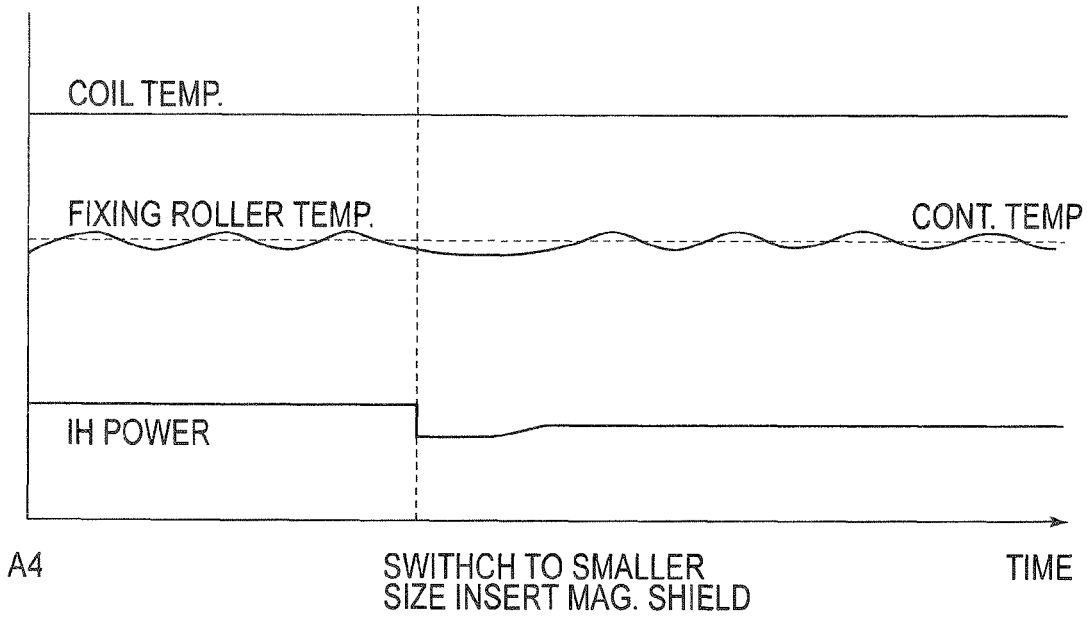
FIG. 1 is a drawing showing the gist of the first embodiment of the present invention.

The amount of electric power necessary for image fixation is effected by the type of object to be heated, that is, the type of a recording sheet or the like. Therefore, the temperature of the fixation roller can be kept constant by carrying out the control in this embodiment after switching the amount of the electric power input to 500 W, that is, shifting the amount of the electric power input in terms of median, at the same time as the starting of the partial blocking of the magnetism, as shown in FIG. 1. As for the temperature of the coil during this period, it remains constant regardless of whether or not the magnetism is partially blocked, and the type of recording paper.

Figure 8:
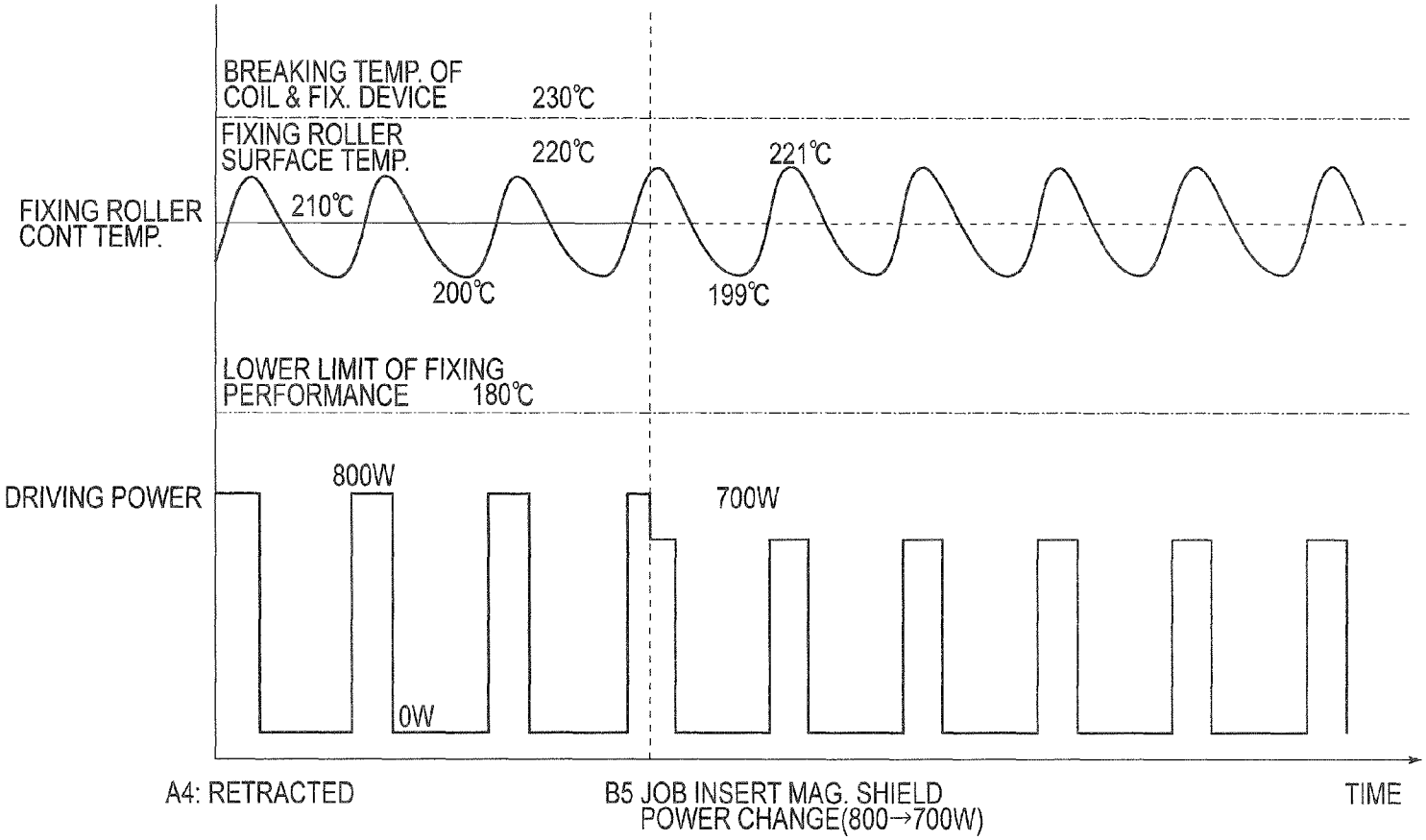
FIG. 8 is a diagrammatic drawing showing the relationship between the changes in the temperature of the fixation roller and the amount of the electric power input, in the first embodiment of the present invention.

In this embodiment:

Next, it is assumed that a user selected a job in which multiple copies were continuously made using recording sheets of size A4. FIG. 8 shows the temperature distribution, and the changes in the amount of electric power input that occurred while the job was being done. When recording sheets of size A4 are used, the fixation roller needs to be heated across its entirety in terms of its lengthwise direction. Therefore, the magnetism blocking member is kept in the retreat position. For this job, the target temperature level for image fixation was set to 210° C. The temperature level above which the fixing apparatus, in particular, the coil thereof, would be damaged was 230° C., and the temperature level below which image fixation would not be satisfactory was 180° C. The base amount of electric power supplied to drive the magnetic flux generating means was 800 W. The power source for driving the magnetic flux generating means was turned on or off in response to the temperature of the fixation roller detected by the thermistor. The amount of the temperature ripple was ñ10° C. In other words, the temperature of the heat roller rose to as high as 220° C.

Next, it is assumed that a user selected a job in which multiple copies were continuously made using recording sheets of size B5. When a recording sheet of size B5 is used for image formation, the heat roller has to be heated across only a part thereof, in terms of its lengthwise direction. Therefore, as soon as the job was started, the magnetism blocking member was inserted. With no change to the control, the temperature of the heat roller would reach 240° C., above which the coil would be damaged, as it would have been in the first embodiment. Thus, the amount by which electric power was to be supplied while the magnetism was partially blocked was set to 700 W while keeping the target temperature at 210° C. With this modification to the control, the amount of the temperature ripple reduced to ñ11° C., which was virtually the same as when the magnetism was not blocked. Consequently, the temperature of the heat roller reached no higher than 221° C., and fell no lower than 199° C. In other words, not only did the excessive temperature rise not occur, but also, eddy current was not induced by an excessive amount. Thus, fixation occurred with no problem.

There is the possibility that if the magnetism adjusting member is inserted while the amount of electric power input is kept at the same level as the amount by which electric power is inputted while the magnetism adjusting member is not in the magnetism adjusting position, the power source for driving the magnetic flux generating means will be destroyed by the excessive amount of current (rush current) which flows the instant the magnetism adjusting member is inserted. The occurrence of this phenomenon depends on the capacity of the power source. Therefore, this problem, or the destruction of the power source, can be prevented by ensuring that the magnetism adjusting member is inserted after the amount of the electric power input is switched to the amount by which the electric power is to be supplied while the magnetism is adjusted.

However, reducing the amount by which electric power is to be supplied while the magnetism is partially blocked increases the efficiency with which the heat roller is heated by electromagnetic induction. The amount $W_{loss\text{-}coil}$ by which the electric power supplied to the heating means is lost due to the heat generation in the coil itself can be expressed as follows, in consideration of the Duty, that is, the ratio of the length of time electric current is flowed through the coil per unit length of time:

$$W_{loss\text{-}coil}=I_{coil}^2\times R_{coil}\times \text{Duty}.$$

If the ratio of the length of time the power source was on was 20%, the average amount by which the magnetic flux generating means is driven is 160 W. Provided that the voltage of the power source is 100 V, when the control settings are kept to the original values, the amount $W_{loss\text{-}coil}$ by which electric power is lost by the coil can be calculated using the following equation:

$$W_{loss\text{-}coil\ 800W}=(800/100)^2\cdot R_{coil}\cdot(20/100)$$

$$W_{loss\text{-}coil\ 160W}=(160/100)^2\cdot R_{coil}\cdot(100/100).$$

Therefore, the amount of the power loss can be reduced to ⅕(=$W_{loss\text{-}coil\text{-}160\ W}/W_{loss\text{-}coil\text{-}800W}$), increasing thereby the effective amount of power, by changing the amount and duty by which electric power is to be supplied while the magnetism is partially blocked, to 160 W and 100%, respectively.

If the magnetic flux generating means has been supplied with a proper amount of power before the magnetism blocking member is inserted, inserting the magnetism blocking member without changing the amount of the electric power input increases the amount of the loss, as described above. Thus, when it is necessary to partially block the magnetism, the electric power supplied to the magnetic flux generating means can be increased in effective amount, by switching, as in this embodiment, the amount of electric power input. In other words, as a magnetism block signal is inputted, the magnetism adjusting member is to be moved at the same time as the power control is switched to the power control to be used when the magnetism blocking member is moved, or a predetermined length of time after the inputting of the magnetism block signal, or in response to a magnetism blocking member movement start signal.

In the above, the control method in which the amount of electric power input is changed immediately before the insertion of the magnetism adjusting member, was described. Instead, however, the electric power control table itself may be changed.

Embodiment 2

The image heating apparatus in this embodiment is basically the same in structure as that in the first embodiment. In this embodiment, however, instead of changing the amount of the electric power input, the target temperature level at which the temperature of the fixation roller is to be kept when the magnetism needs to be partially blocked is rendered lower than that when the magnetism does not need to be partially blocked, as will be described next.

Figure 6:
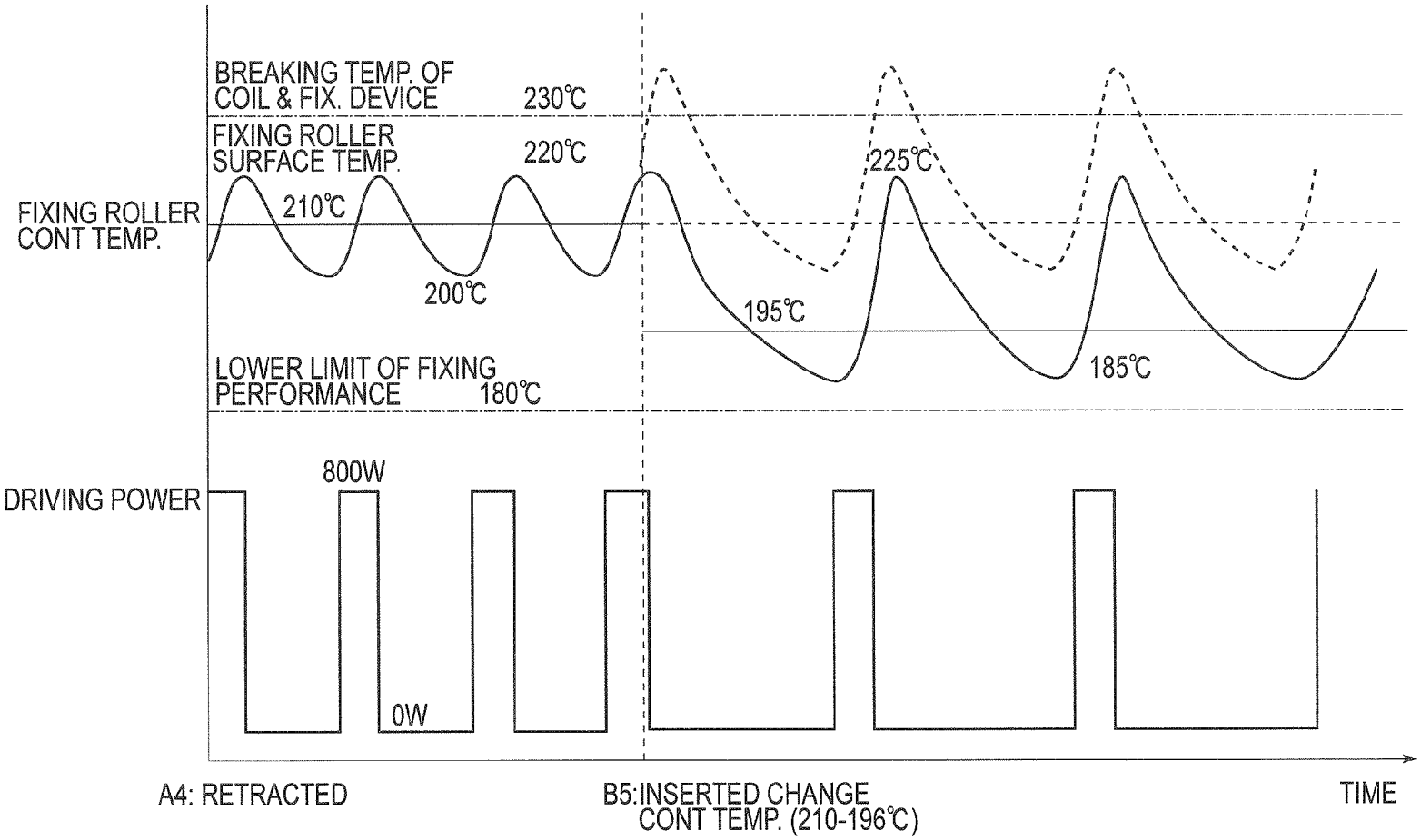
FIG. 6 is a diagrammatic drawing showing the relationship between the changes in the temperature of the fixation roller and the amount of the electric power input, in the second embodiment of the present invention.

FIG. 6 shows the temperature distribution of the fixation roller, and the changes in the amount of the electric power input, which occurred after a user selected a job in which multiple copies were continuously made using recording sheets of size A4. When a recording sheet of size A4 was used as the recording medium, the fixation roller needed to be heated in its entirety in terms of its lengthwise direction, and, therefore, the magnetism blocking member was kept in the retreat position. For this job, the target temperature level, or the temperature level at which the temperature of the fixation roller is to be kept, was 210° C. The temperature level above which the fixing apparatus, in particular, the coil thereof, would be damaged was 230° C., and the temperature level below which image fixation would not be satisfactory was 180° C. The amount of the electric power input was 800 W. The power supply to the inductive heating apparatus was turned on or off in response to the temperature of the heat roller of the fixing apparatus detected by the thermistor disposed in the adjacencies of the heat roller. The amplitude of the temperature ripple which occurred during this job was ñ10° C. relative to the target temperature. In other words, the temperature of the heat roller rose as high as 220° C.

Next, the user selected a job in which multiple copies were continuously made using recording sheets of size B5. When a recording sheet of size B5 is used for image formation, the heat roller has to be heated across only a part thereof in terms of its lengthwise direction. Therefore, as soon as the job was started, the magnetism blocking member was inserted. With no change made to the control, the temperature of the center portion of the heat roller would have excessively risen—a test showed the amplitude of the temperature ripple was 30° on the plus side, and 10° C. on the minus side. In other words, with the target temperature kept at 210° C., the temperature of the center portion of the heat roller would have reached as high as 240° C., which is high enough for the coil to be damaged. In this embodiment, therefore, the target temperature level at which the temperature of the heat roller was to be kept while the magnetism was partially blocked was set to 195° C. Because of radiation, the surface temperature of the fixation roller tends to be lower across the lengthwise end portions than across the center portion. Further, the thermistor is disposed in the adjacencies of the center portion of the fixation roller in terms of the lengthwise direction of the fixation roller. Therefore, when recording mediums of size A4 are used for image formation, the temperature of the portions of the fixation roller, which correspond in position to the edge portions of the recording medium in terms of the width direction of the recording medium, sometimes falls to as low as 180° C. even if the target temperature is set to 210° C. In comparison, the temperature of the portion of the fixation roller within the path of a recording medium of size B5 is smaller in terms of the degree of nonuniformity than the portion of the fixation roller within the path of the recording medium of size A4. Thus, even if the target temperature is set to 195° C., the lowest temperature level to which the temperature of the portion of the fixation roller corresponding in position to the edge portions of the recording medium of size B5 falls will be no lower than 180° C. With the employment of the control method in this embodiment, therefore, the highest temperature level to which the center portion of the heat roller reached was 225° C., and the lowest temperature level to which the center portion of the fixation roller fell was 185° C. Consequently, images were satisfactorily fixed with the presence of no problem regarding the excessive temperature increase.

Figures 10, 11:
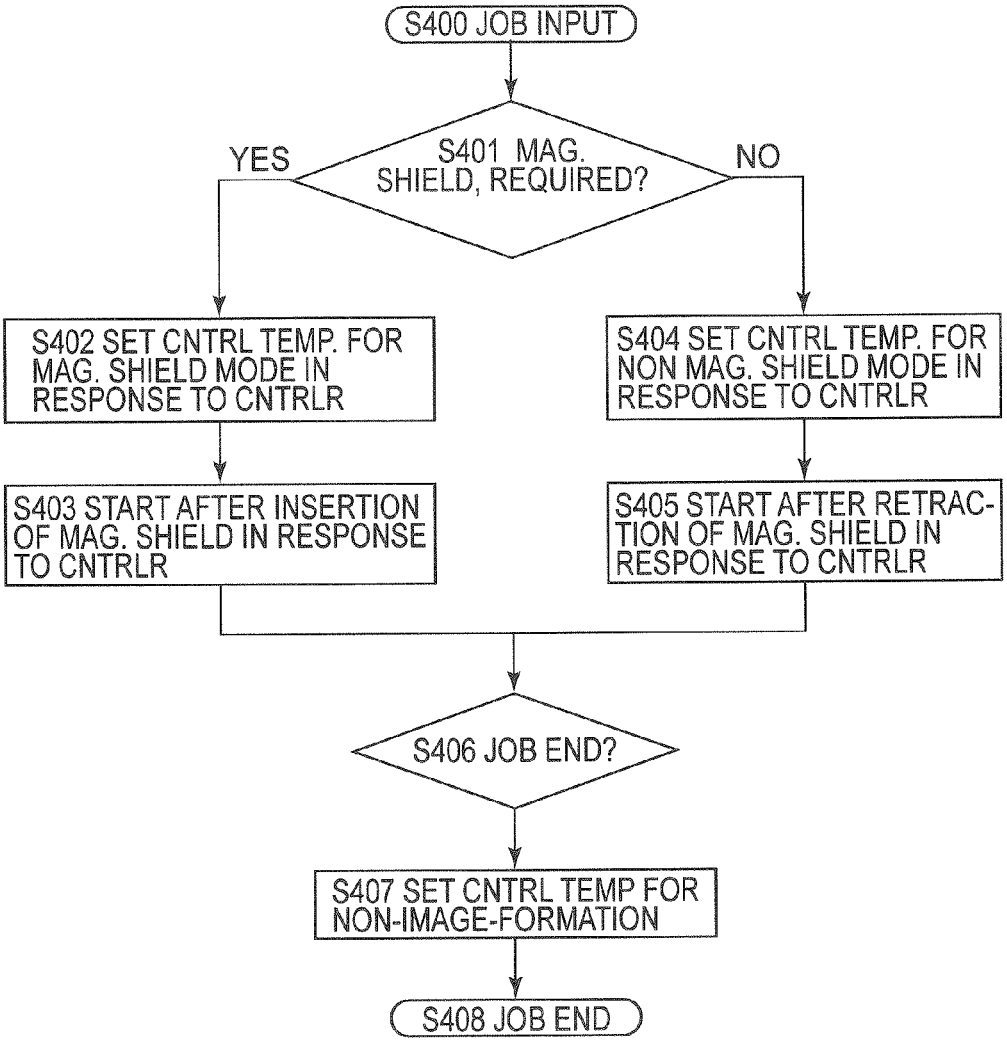
FIG. 10 is a table showing the values used for controlling the amount by which electric power is supplied to the coil in the first embodiment.
FIG. 11 is a flowchart of the control sequence in the third embodiment of the present invention.
Figure 12:
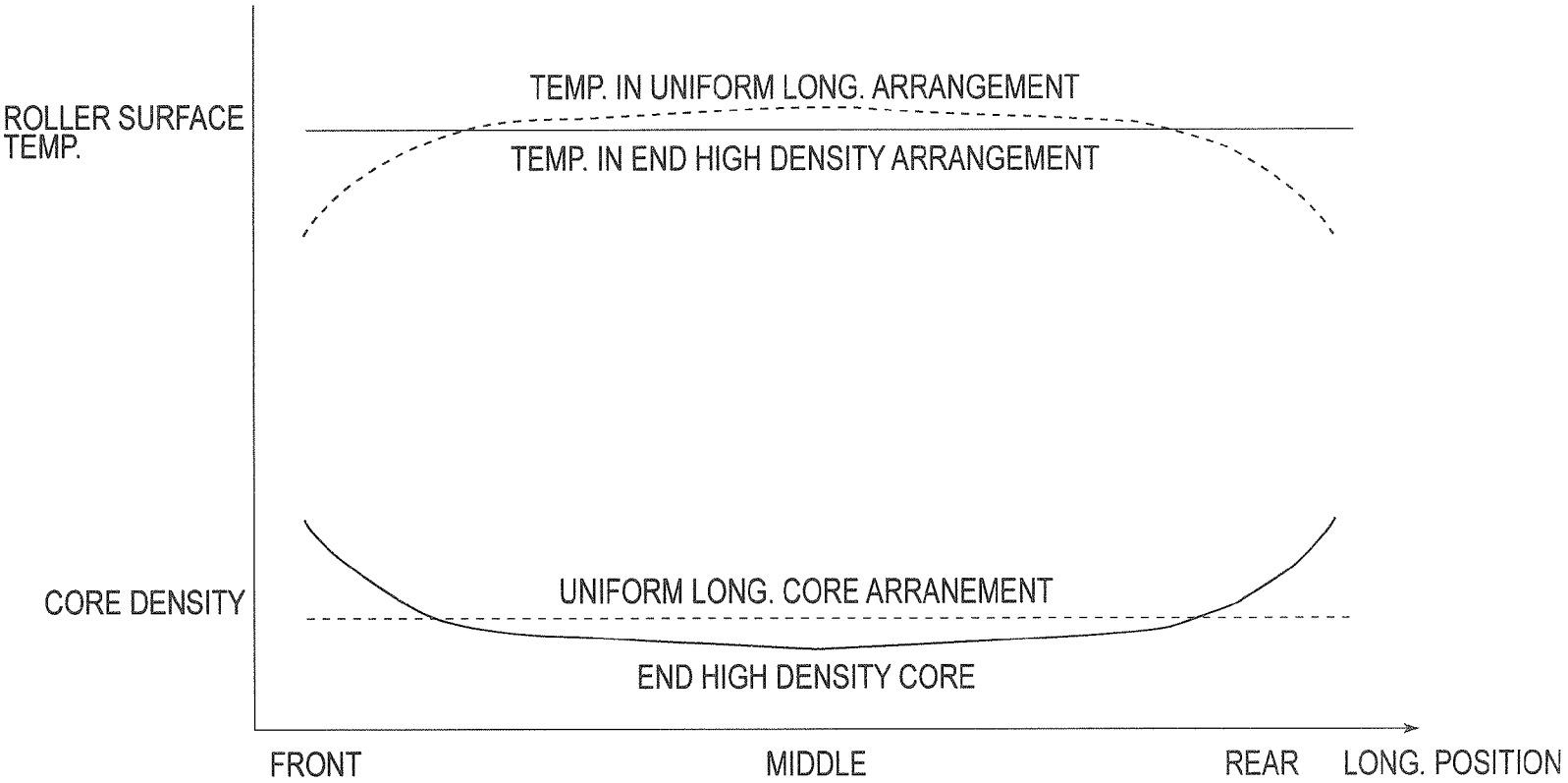
FIG. 12 is a diagrammatic drawing showing the relationship between the lengthwise density distribution of the core and the lengthwise surface temperature distribution of the fixation roller, in the third embodiment of the present invention.
Figure 13:
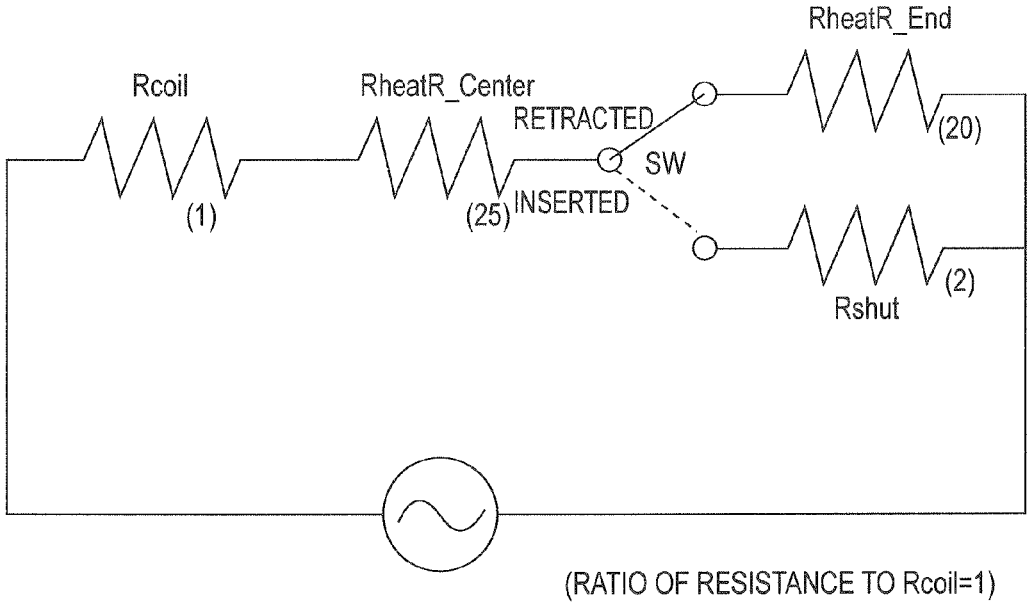
FIG. 13 is an equivalent circuit of the induction-based heating apparatus in the third embodiment of the present invention.

At this time, the control sequence in this embodiment will be described with reference to FIG. 11.

First, the signal indicating the selected image formation job is inputted in Step S400. In Step S401, it is determined whether or not it is necessary to partially block magnetism by the magnetism adjusting member. For example, when the width of the recording sheet is equal to that of a recording sheet of size A4, in terms of the direction perpendicular to the recording medium conveyance direction, it is determined that the magnetism does not need to be partially blocked, whereas, when it is not more than that of a recording sheet of size B5, it is determined that the magnetism needs to be partially blocked. Then, when the partial blocking of the magnetism is necessary, Step S402 is taken, in which as a magnetic blocking signal is inputted, the target temperature is switched to 195° C. Then, the process of moving the magnetism adjusting member is started (S103).

Before, or at the same time as, the magnetism blocking member is inserted, the target temperature level for temperature control to be used while the magnetism adjusting member is moved must be switched to the normal target temperature level for temperature control (target temperature level to be used while magnetism is not blocked). In this embodiment, the same temperature level as the temperature level used for temperature control while moving the magnetism adjusting member is used as the target temperature level for temperature control after the moving of the magnetism adjusting member into the second position. However, the target temperature level for temperature control used after the moving of the magnetism adjusting member into the second position may be different from that for temperature control while moving the magnetism blocking member, as long the former is lower than the normal target temperature level for temperature control. When it is determined in Step S401 that the magnetism does not need to be blocked, the normal electric power control is carried out (S404). Then, it is determined whether or not the magnetism adjusting member is in the first position (S405). Then, it is determined whether or not the job has been completed (S406). When it is determined that the job has been completed, the fixing apparatus is put on standby (S407), and the operation is ended (S408).

Embodiment 3

The image heating apparatus in this embodiment is basically the same in structure as that in the first embodiment. In this embodiment, however, the core of the magnetic field generating means is rendered higher in density across the lengthwise end portions thereof than across the center portion.

For the purpose of reducing the fixing apparatus in electric power consumption and warm-up time, more often than not the heating member is reduced in thermal capacity. However, if the heating member is reduced in thermal capacity, the amount of heat that can be stored therein becomes rather small. Therefore, the amount by which the temperature of the heating member decreases is greater, in particular, across the lengthwise end portions of the heat roller, because, unlike the center portion of the heat roller, these portions (heat sources) are not exposed to the electromagnetic flux from both sides, in terms of the lengthwise direction thereof, and also, there are a number of thermal radiation sources such as the motor, gears, etc., which are disposed in the adjacencies of the lengthwise end portions of the heating member. In other words, if the heating member is reduced in thermal capacity, the problem that the temperature of the heating member becomes substantially lower across the lengthwise end portions than the center portion occurs. As one of the methods for preventing this problem, it is possible to adjust the amount by which heat is generated in the lengthwise end portions of the heating member, by rendering the end portions of the core higher in density than the center portion of the core, in order to render the lengthwise end portions of the heating member greater in magnetic flux density than the center portion of the heating member. When this method was employed, the ratio among the abovementioned various electrical resistances was:

$$R_{coil}:R_{heatR\text{-}Center}:R_{heatR\text{-}End}:R_{shut}=1:20:25:2.$$

In this case, the lengthwise center portion of the core is less dense than the lengthwise end portions of the core. Therefore, if the magnetism blocking member is inserted without some modification to the control sequence, the amount by which heat is generated in the core is greater than the amount by which heat is generated in the core when the lengthwise end portions of the core is the same in density as the lengthwise center portion of the core. In the first embodiment, the amount of the heat generated in the coil when the magnetism was partially blocked was 1.56 times the amount of the heat generated in the coil when the magnetism was not blocked. However, in this embodiment, that is, when the lengthwise end portions of the core are greater in density than the lengthwise center portion of the core, the amount of the heat generated in the coil when the magnetism is partially blocked will become 2.00 times the amount of the heat generated when the magnetism is not blocked, according to Equation (5), unless some modification is made to the control sequence. In addition, the amount by which the electrical resistance R of the heating member reduces across the portions shielded by the magnetism adjusting member in this embodiment is greater than that in the first embodiment. Therefore, the amount of the current increase is greater. Therefore, if the magnetism blocking means is inserted without changing the target temperature, amount of the electric power input, coefficient of control, etc., the problems mentioned in the description of the first to third embodiments will become conspicuous.

However, as long as one among the target temperature, amount of the electric power input, and control adjustment table, any combination thereof, or all of them, are changed, as in this embodiment of the present invention, before, or at the same time as, the magnetism is partially blocked, satisfactory effects, the level of satisfactoriness of which correspond to the types of the selected changes, will be obtained. That is, the above described problems that the electric power source is damaged by eddy current; the fixating apparatus, in particular, the coil thereof, is damaged by the excessive increase in the temperature of the heating member; copies which are nonuniform in glossiness are yielded; etc., do not occur. Further the performance of the fixing apparatus in this embodiment is as satisfactory as the performances of the fixing apparatuses with the cores of which are uniform in density across their entirety in terms of their lengthwise directions.

While the invention has been described with reference to the structures disclosed herein, it is not confined to the details set forth, and this application is intended to cover such modifications or changes as may come within the purposes of the improvements or the scope of the following claims.

This application claims Priority from Japanese Patent Application No 30833712004 filed Oct. 22, 2004, which is hereby incorporated by reference.

What is claimed is:

1. An image heating apparatus comprising:

an excitation coil;

an image heating member configured to heat a toner image on a sheet, said image heating member generating heat by magnetic flux from said excitation coil;

a magnetic flux constraining member configured to constrain a part of the magnetic flux actable on said image heating member;

a moving mechanism configured to move said magnetic flux constraining member between a first position where the magnetic flux directed toward a predetermined longitudinal end region of said image heating member is not constrained and a second position where the magnetic flux directed toward the predetermined longitudinal end region of said image heating member is constrained; and an electric power controller configured to control electric power supplied to said excitation coil, wherein said electric power controller changes the electric power supplied to said excitation coil from a first amount of electric power to a second amount of electric power, which is smaller than the first amount of electric power, upon a moving operation of said magnetic flux constraining member from the first position to the second position, and continues the supply of the second amount of electric power to said excitation coil after said magnetic flux constraining member is moved to the second position.

2. The image heating apparatus according to claim 1, wherein when a sheet having a maximum width usable with said apparatus is processed by said apparatus, said magnetic flux constraining member is in the second position, and when a sheet having a width smaller than the maximum width is processed by said apparatus, said magnetic flux constraining member is in the first position.

3. The image heating apparatus according to claim 2, further comprising a temperature detector configured to detect a temperature of a longitudinal central area of said image heating member, said electric power controller controlling the turning on and turning off of the electric power supplied to said excitation coil based on an output of said temperature detector during an image heating process.

4. The image heating apparatus according to claim 2, wherein said moving mechanism rotates said magnetic flux constraining member between the first position and the second position.

5. The image heating apparatus according to claim 4, wherein said image heating member is a hollow roller, said excitation coil is disposed inside said hollow roller, and said magnetic flux constraining member is movable inside said hollow roller.

6. An image heating apparatus comprising:

an excitation coil;

an image heating member configured to heat a toner image on a sheet, said image heating member generating heat by magnetic flux from said excitation coil;

a magnetic flux constraining member configured to constrain a part of the magnetic flux actable on said image heating member in a longitudinal direction of said image heating member, a moving mechanism configured to move said magnetic flux constraining member between a first position where an image heating operation for a sheet having a maximum width usable in said apparatus is performed and a second position where an image heating operation for a sheet having a predetermined width narrower than the maximum width is performed; and an electric power controller configured to control electric power supplied to said excitation coil, wherein said electric power controller changes the electric power supplied to said excitation coil from a first amount of electric power to a second amount of electric power, which is smaller than the first amount of electric power, upon a moving operation of said magnetic flux constraining member from the first position to the second position, and continues the supply of the second amount of electric power to said excitation coil after said magnetic flux constraining member is moved to the second position.

7. The image heating apparatus according to claim 6, further comprising a temperature detector configured to detect a temperature of a longitudinal central region of said image heating member, said electric power controller controlling the turning on and turning off of the electric power supplied to said excitation coil based on an output of said temperature detector during an image heating process.

8. The image heating apparatus according to claim 7, wherein said magnetic flux constraining member constrains the magnetic flux directed toward a longitudinal end region of said image heating member from said excitation coil when said magnetic flux constraining member is in the second position.

9. The image heating apparatus according to claim 8, wherein said image heating member is a hollow roller, said excitation coil is disposed inside said hollow roller, and said magnetic flux constraining member is movable inside said hollow roller.

* * * * *